US006098797A

United States Patent [19]

Han

[11] Patent Number: 6,098,797

[45] Date of Patent: Aug. 8, 2000

[54] GOLF BAG WITH SUPPORT STAND

[76] Inventor: Dong-Kyu Han, 1 Saros, Irvine, Calif. 92612

[21] Appl. No.: 09/218,993

[22] Filed: Dec. 22, 1998

[51] Int. Cl.[7] ..... A63B 55/00; A63B 55/06

[52] U.S. Cl. ..... 206/315.7; 206/315.3; 248/96

[58] Field of Search ..... 206/315.3, 315.7, 206/315.8; 248/96

[56] References Cited

U.S. PATENT DOCUMENTS

| | | | |
|---|---|---|---|
| 1,757,471 | 5/1930 | Platt | 248/96 |
| 2,430,107 | 11/1947 | Cronrath . | |
| 4,620,682 | 11/1986 | Yim | 248/96 |
| 4,798,357 | 1/1989 | Cho | 206/315.7 X |
| 4,834,235 | 5/1989 | Solheim et al. | 206/315.7 |
| 4,921,192 | 5/1990 | Jones | 248/96 |
| 5,147,089 | 9/1992 | Anderson | 206/315.7 X |
| 5,152,483 | 10/1992 | Maeng | 248/96 |
| 5,154,377 | 10/1992 | Suk | 248/96 |
| 5,186,424 | 2/1993 | Shultz et al. | 248/179 |
| 5,209,350 | 5/1993 | Maeng | 206/315.7 |
| 5,340,063 | 8/1994 | Hsieh | 248/96 |
| 5,415,285 | 5/1995 | Reimers | 206/315.7 |
| 5,464,180 | 11/1995 | Cheng | 248/96 |
| 5,507,384 | 4/1996 | Maeng | 206/315.7 |
| 5,516,064 | 5/1996 | Hsieh | 248/96 |
| 5,549,263 | 8/1996 | Maeng | 248/96 |
| 5,607,128 | 3/1997 | Suk | 248/96 |
| 5,678,791 | 10/1997 | Maeng | 206/315.7 X |
| 5,762,189 | 6/1998 | Reimers | 206/315.7 |
| 5,799,786 | 9/1998 | Beck et al. | 206/315.7 |
| 5,829,719 | 11/1998 | Han | 206/315.7 X |
| 5,901,845 | 5/1999 | Cheng | 306/315.7 |

*Primary Examiner*—Sue A. Weaver
*Attorney, Agent, or Firm*—Jonathan Y. Kang; Lee & Hong

[57] ABSTRACT

A golf bag having a body and support legs pivotally attached to the body and actuated by an actuator shaft which is partially hidden inside the body. The actuator shaft is actuated by an actuator assembly comprising a base member and an actuator plate. When the bag is tilted, the actuator plate cooperates with the actuator shaft to cause the legs to pivot away from the bag body to form a support for the bag. The actuator mechanism and the lower portion of the actuator shaft are located inside the golf bag body.

19 Claims, 5 Drawing Sheets

GOLF BAG WITH SUPPORT STAND

BACKGROUND OF THE INVENTION

1. Field of the Invention

This invention relates to golf bags, and more particularly to golf bags with extendable and retractable support stands which act in cooperation with an actuator mechanism to support the golf bag at an angle.

2. Description of Related Art

Golf is one of the most widely played sports activities in the United States. Not only is this activity already widespread, but the number of golfers continue to grow due to popularity of the sports caused by high stake games televised on televisions.

The sport of golf is typically played with a set of golf clubs which are commonly placed in a golf bag. When a golf bag is carried by a golfer, it is desirable to include a stand which supports the golf bag in its upright position to allow easy access to the golf clubs. Conventionally, this function has been accommodated by providing legs which are extendable when the golf bag is placed on the ground and retractable when the golf bag is carried.

Various methods have been used to move the legs between their retracted and extended positions. One method is described in U.S. Pat. No. 5,154,377 to Suk (the "Suk reference"). In the Suk reference, before a pair of legs can be used to support a golf bag, a slide member must be moved in a descending position along a two parallel groove track formed in a slide bracket. When the extending feature of the legs are not needed, the user must then manually move the slide member in an upward position along the track. The manual operation of the sliding member may be cumbersome to some golfers.

Another conventional golf bag stand is described in U.S. Pat. No. 5,152,483 to Maeng (the "Maeng reference"). In the Maeng reference, the pair of legs extend away from the golf bag to provide support when the golf bag is forcefully tilted with respect to the ground. In such a position, the contact surface area of the golf bag with the ground is minimal, which comprises the tips of two legs and an edge of the golf bag, and thus possible causing the golf bag to tip over when it is placed on a slope or irregular surface. In addition, a horizontal drive member pivotally mounted to a base of the golf bag in the Maeng reference must be sufficiently rigid and large to withstand the tilting force, because the drive member must provide all of the actuating force to the U-shaped actuating member.

In these prior golf bags, however, the mechanism that actuates the leg movements is disposed outside of the body of the golf bag and directly contact the ground. The actuator mechanism is therefore susceptible to damages.

In addition, because the base plate that activates the actuator mechanism extends beyond the base of the golf bag, the base plate may damage equipment near the golf bag.

SUMMARY OF THE DISCLOSURE

It is an object of the present invention to provide a golf bag having support legs and an actuator mechanism which act in cooperation therewith that obviates one or more problems of the prior art.

It is a further object of the present invention to provide a golf bag having the actuator mechanism not protruding from the bag body and becoming an obstacle to other nearby equipment.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

According to one embodiment of the present invention, a golf bag has a body having a side surface and a bottom end, the body defining a longitudinal axis. The golf bag further has two legs pivotally connected to the body and are able to pivot between a retracted position where the legs are disposed substantially longitudinally along the side surface of the body and an extended position where lower ends of the legs are spaced apart from the body. An actuator shaft is disposed substantially longitudinally along the side surface of the body and longitudinally moveable relative to the body. A lower portion of the actuator shaft is disposed inside the body. The actuator shaft is connected at an upper portion to the legs so that the longitudinal motion of the actuator shaft effects the pivoting motion of the legs. The golf bag also has an actuator mechanism coupled to the body near the bottom end thereof. The actuator mechanism is connected to the lower portion of the actuator shaft to effect the longitudinal motion of the actuator shaft.

According to one aspect of the present invention, the actuator mechanism comprises a base member disposed at the bottom end of the body. The base member has a bottom face substantially perpendicular to the longitudinal axis of the body and a slanted face disposed above the bottom face at an angle therewith to define a cutout region. Moreover, an actuator plate is disposed within the cutout region defined by the base member and pivotally connected thereto. The actuator plate is able to pivot between a first position where it is disposed within the plane of the bottom face of the base member, and a second position where it is disposed near the slanted face. The lower end of actuator shaft is connected to the actuator plate so that the actuator shaft moves longitudinally when the actuator plate pivots between the first and the second position.

According to another aspect of the present invention, the actuator mechanism further comprises a membrane attached to the base member and to the actuator plate to at least partially enclose the cutout region defined by the base member. The membrane is preferably made of a resilient material and tends to urge the actuator plate to pivot to its first position. The membrane may also be made of a transparent material to expose the interior mechanisms of the golf bag.

According to a second embodiment of the present invention, a golf bag has a body having a side surface and a bottom end, the body defining a longitudinal axis. Two legs are pivotally attached to the body and are able to pivot between a retracted position where the legs are disposed substantially longitudinally along the side surface of the body and an extended position where lower ends of the legs are spaced apart from the body. An actuator shaft is disposed substantially longitudinally along the side surface of the body and longitudinally moveable relative to the body. The actuator shaft is connected at an upper portion to the legs so that the longitudinal motion of the actuator shaft effects the pivoting motion of the legs. The golf bag also has a base member disposed at the bottom end of the body. The base member has a bottom face and a slanted face extending from the bottom face at an angle therewith to define a cutout region. An actuator plate is disposed within the cutout region defined by the base member and pivotally connected to the base member. The actuator plate is able to pivot between a first position where it is disposed within the plane of the bottom face of the base member, and a second position where it is disposed near the slanted face. A lower end of actuator shaft is connected to the actuator plate so that the actuator shaft moves longitudinally when the actuator plate pivots between the first and the second position. In addition, a membrane is attached to the base member and to the actuator plate to at least partially enclose the cutout region defined by the base member.

The golf bag according to the present invention may be manufactured by forming a body having a side surface and a bottom end, the body defining a longitudinal axis; forming two legs pivotally connected to the body and being able to pivot between a retracted position where the legs are disposed substantially longitudinally along the side surface of the body and an extended position where lower ends of the legs are spaced apart from the body; forming an actuator shaft disposed substantially longitudinally along the side surface of the body and longitudinally moveable relative to the body, a lower portion of the actuator shaft being disposed inside the body, the actuator shaft being connected at an upper portion to the legs so that the longitudinal motion of the actuator shaft effects the pivoting motion of the legs; and forming an actuator mechanism coupled to the body near the bottom end thereof, the actuator mechanism being connected to the lower portion of the actuator shaft to effect the longitudinal motion of the actuator shaft.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
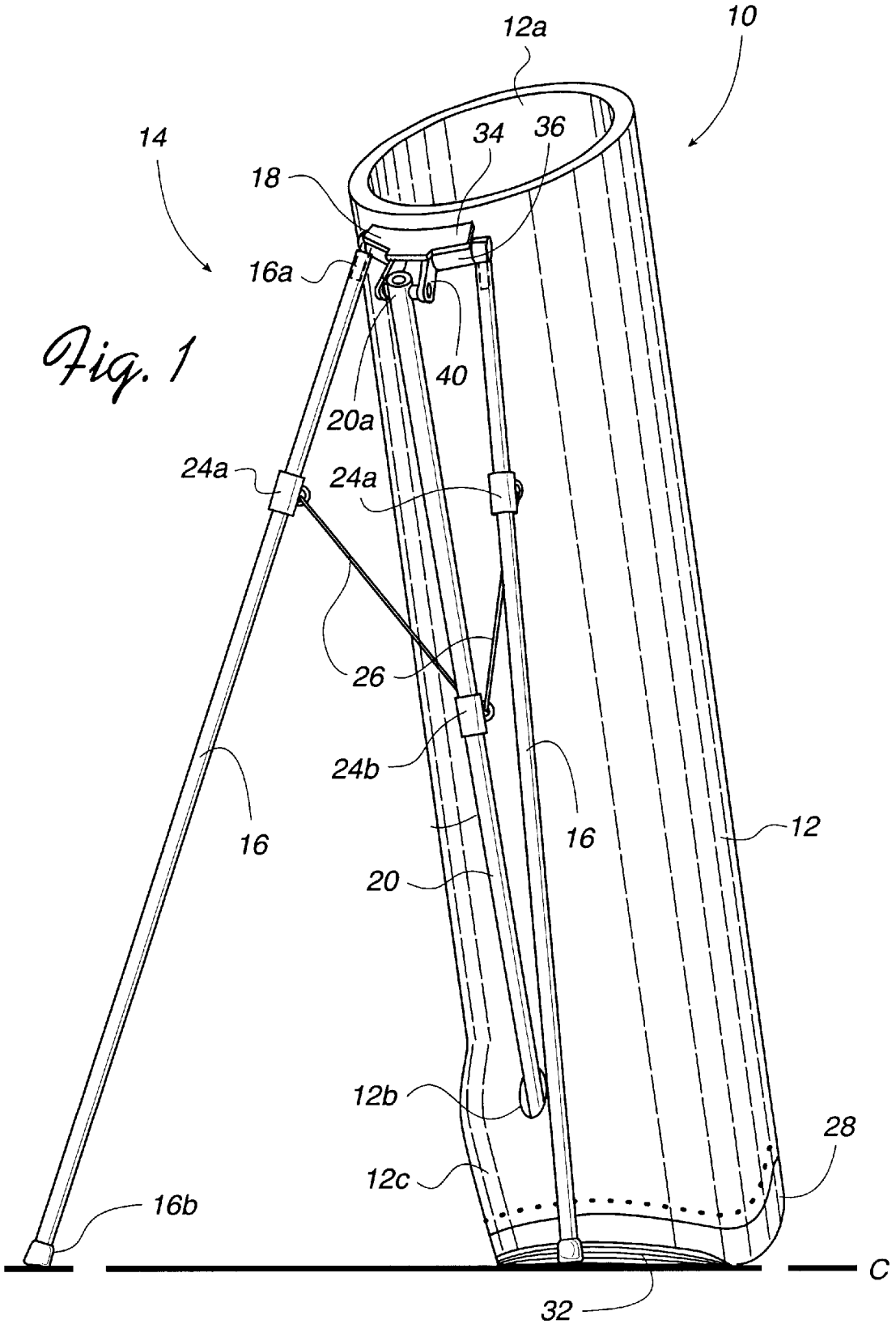
FIG. 1 is a perspective view of a golf bag according to an embodiment of the present invention.
Figure 2:
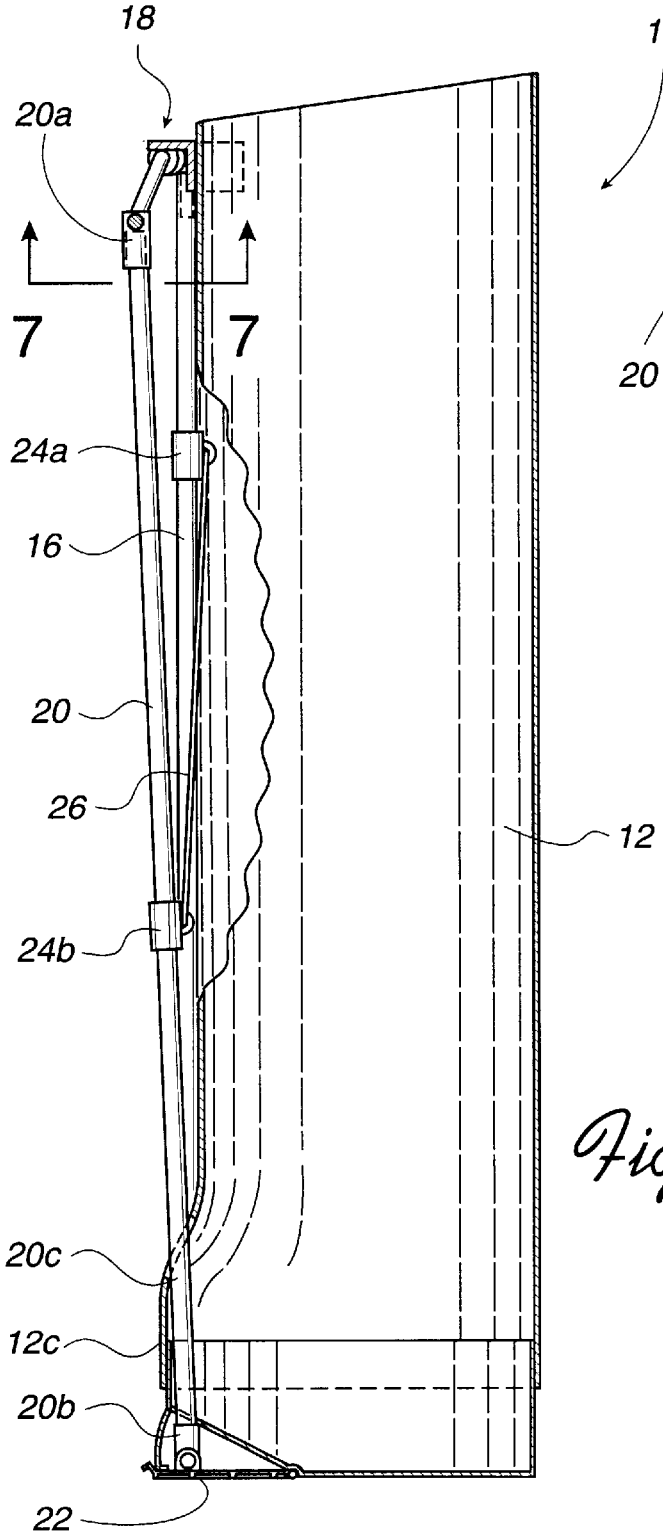
FIG. 2 is a partial sectional view showing the golf bag of FIG. 1 in an upright position with the legs in a retracted position.
Figure 3:
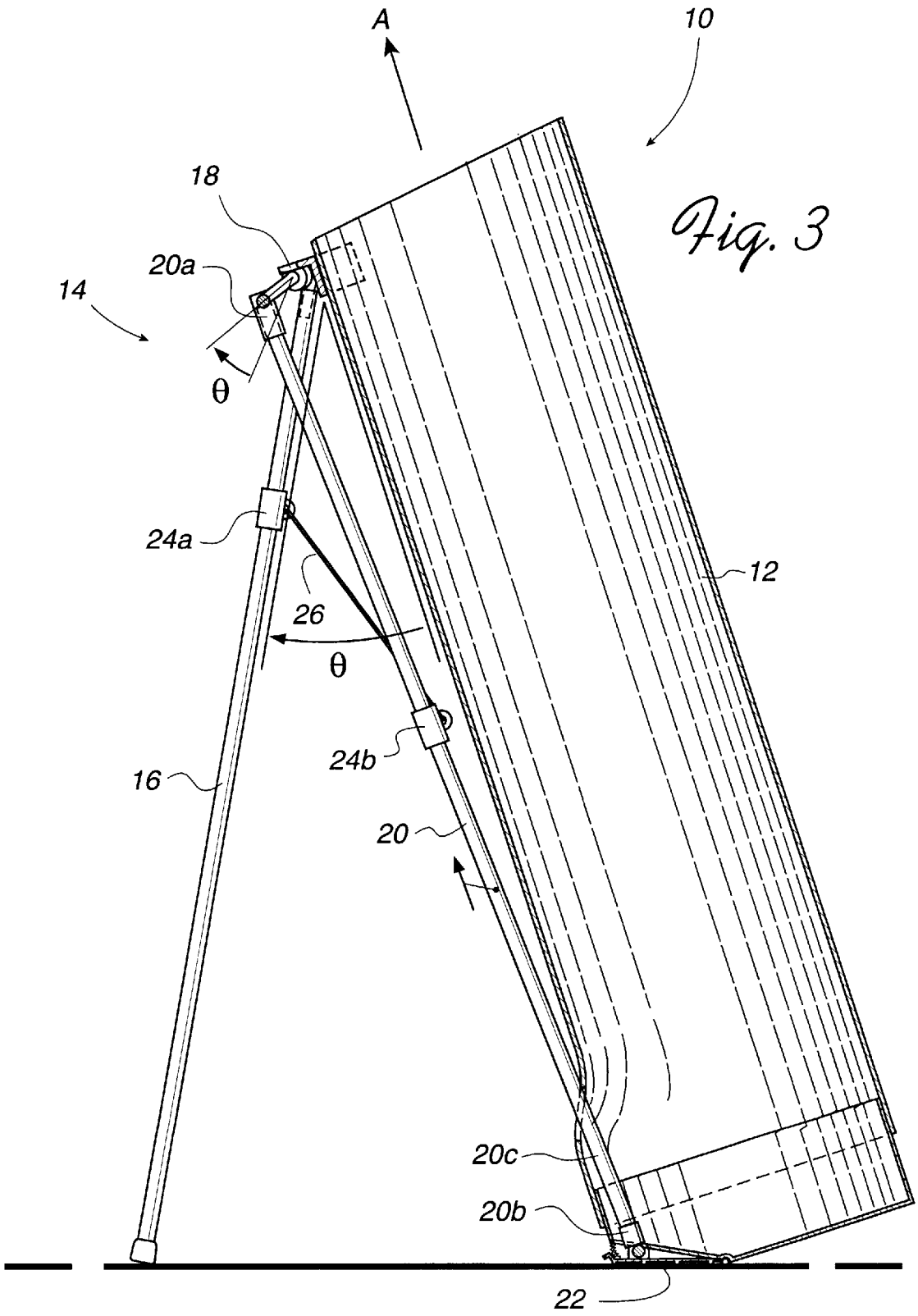
FIG. 3 is a partial sectional view showing the golf bag of FIG. 1 in an extended or leaning position with the legs in an extended position.

A golf bag with a support stand according to an embodiment of the invention is shown in the drawings for purposes of illustration. Referring to FIGS. 1–3, there is shown a golf bag 10 having a bag body 12 and a support stand assembly 14. The bag body 12, which is tubular in shape and has an opening 12*a* at the top, is preferably made of a rigid material and may be covered with a fabric material. The support stand assembly 14 includes two legs 16, the upper ends 16*a* of which are pivotally attached to an attachment assembly 18, which is in turn fixed to the bag body 12, preferably near the opening 12*a* of the bog body 12. The legs 16 may pivot between a retracted position and an extended position. In the retracted position, as shown in FIG. 2, the entire legs 16 are rested along the bag body 12 near an outer surface thereof. In the extended position, as shown in FIGS. 1 and 3, the legs 16 are positioned at an angle θ, preferably between about 20–50 degrees, with respect to an longitudinal axis A of the bag body 12, and the lower ends 16*b* of the legs are spaced apart from the bag body 12. When in the extended position, the lower ends 16*b* of the legs and a bottom portion of the golf bag may contact the ground so that the golf bag stands on the ground in a self-supported and leaning manner.

The pivoting of the legs 16 between the retracted and extended positions is actuated by an actuating mechanism which comprises an actuator shaft 20 extending substantially longitudinally along the bag body 12, and an actuator plate 22 (shown in FIG. 2) located near the bottom of the golf bag. The upper end 20*a* of the actuator shaft 20 is pivotally attached to the attachment assembly 18, and the lower end 20*b* of the shaft 20 is pivotally attached to the actuator plate 22. The shaft 20 is also connected to each of the legs 16 by three tubular members 24*a* and 24*b* mounted on a middle portion of each of the legs 16 and the shaft 20, and thin linking members 26, such as flexible rod or wire, connecting the tubular members 24*a* and 24*b*. The tubular members 24*a* and 24*b* may be slidable along the legs 16 and the actuator shaft 20, or may be fixed thereon. When pushed up at the lower end 20*b* by the actuator plate 22, the actuator shaft 20 moves upwards in a substantially longitudinal direction along the length of the bag body 12 and, through the attachment assembly 18, causes the legs 16 to pivot to their extended position.

Figure 7:
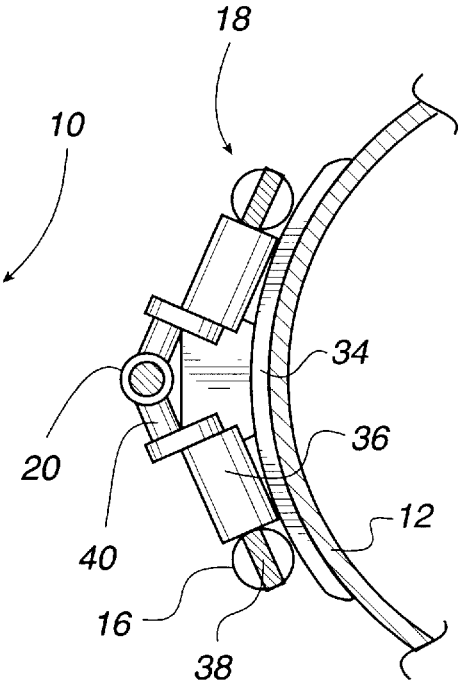
FIG. 7 is a top view of the attachment assembly for the legs and the actuator shaft.

The attachment assembly 18 is described in more detail with reference to FIG. 7 (a top view) as well as FIG. 1. Two tubular members 36 are mounted to the side surface of the bag body 12 via a curved mounting member 34, and a short shaft 38 is inserted through each tubular member 36. Each of the legs 16 is attached perpendicularly to one end of the short shaft 38, and the actuator shaft 20 is attached through an L-shaped member 40 to the other ends of the short shafts 38. The L-shaped member 40 and the legs 16 rotate around the short shaft in a fixed angular relationship. As a result, when the actuator shaft 20 is pushed up, the L-shaped member 40 is rotated, causing the legs 16 to rotate away from the bag body 12.

The major portion of the actuator shaft 20 is located outside of the bag body 12, but the lower part 20*c* of the actuator shaft 20 is hidden inside the bag body. A hole 12*b* on the bag body 12 is provided for this purpose. In addition, the bag body 12 has a bulging part 12*c* to accommodate the lower part 20*c* of the actuator shaft 20.

Figure 4:
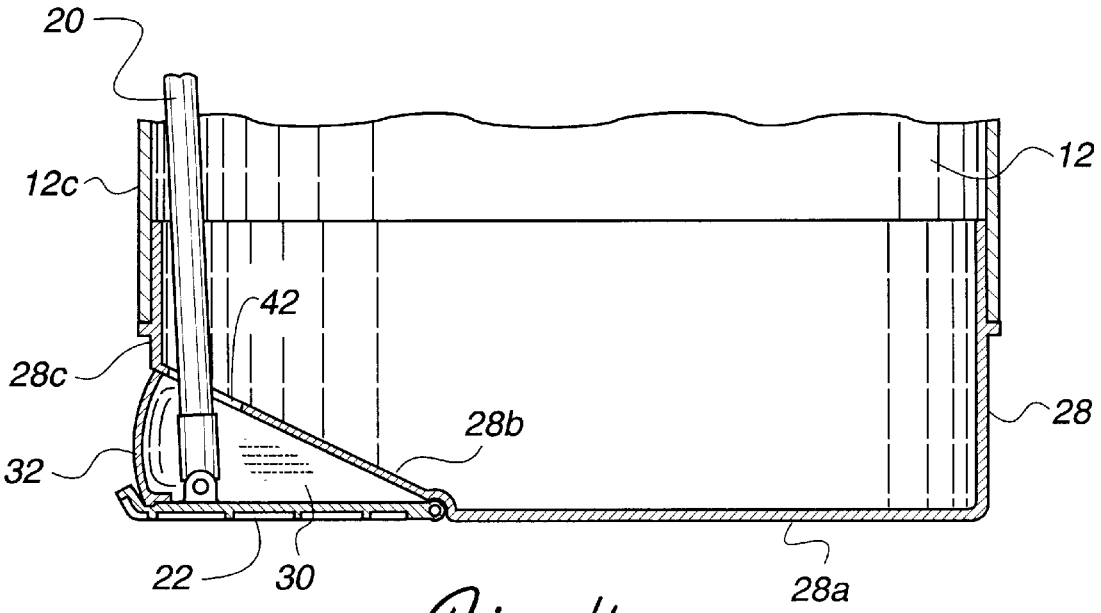
FIG. 4 is a partial sectional view showing the bottom portion of the golf bag of FIG. 1 when the bag is in the upright position.
Figure 5:
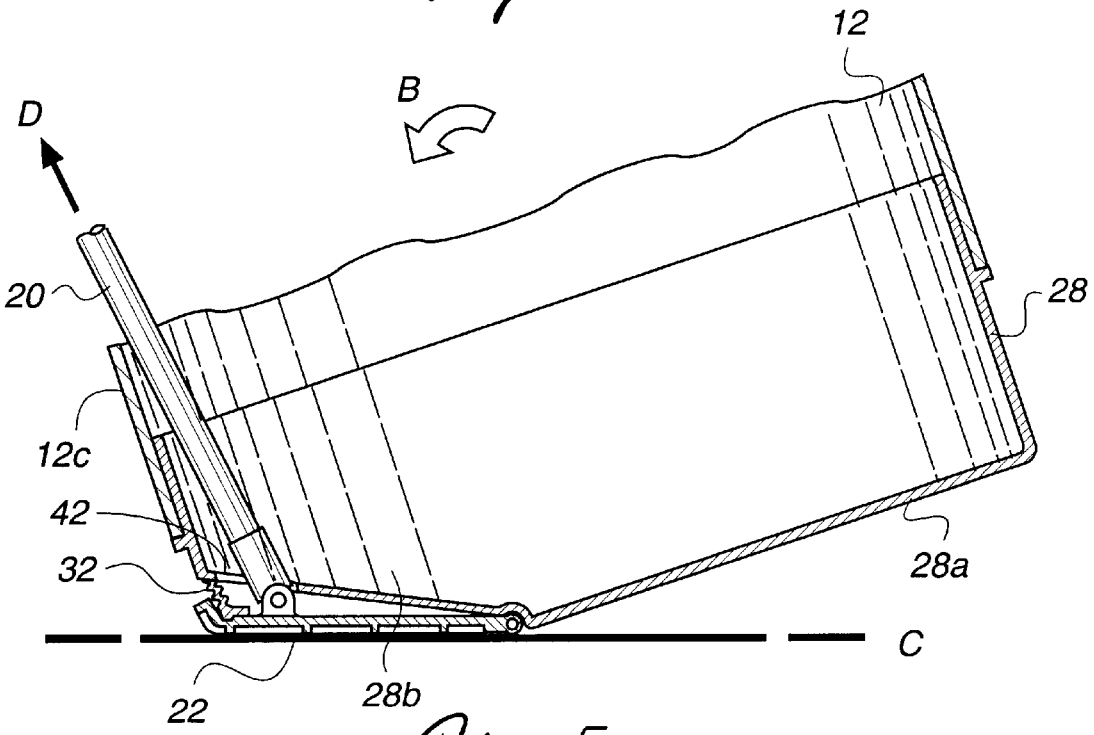
FIG. 5 is a partial sectional view showing the bottom portion of the golf bag of FIG. 1 when the bag is in the leaning position.

The actuator shaft 20 and plate 22 are described in more detail with reference to FIGS. 4, 5 and 6A–6C. As shown in FIGS. 4 and 5, disposed at the bottom of the bag body 12 is a rigid base member 28 which is mounted in a fixed relation with the other portions of the bag body 12. The base member 28, which preferably has a shape similar to a lateral cross-section of the bag body 12, has a bottom face 28*a* substantially perpendicular to the longitudinal axis and a slanted face 28*b*, where the slant face and the plane of the bottom face 28*a* defines a wedge-shaped cutout region 30 under the base member and is preferably made using an injection mold process.

Figure 6A:
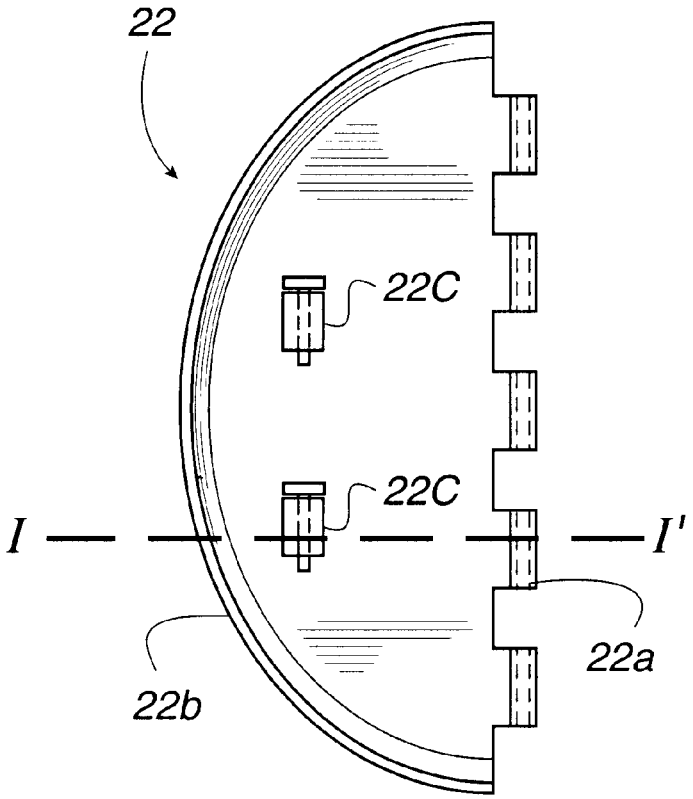
FIG. 6A is a plan view of the actuator plate according to an embodiment of the present invention.
Figure 6B:
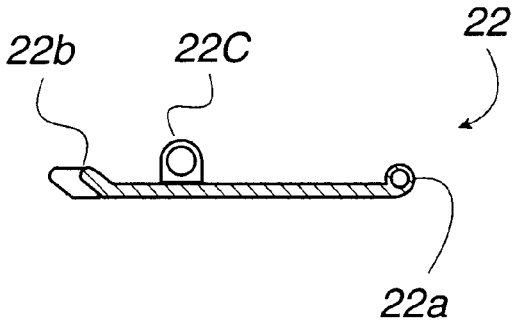
FIG. 6B is an elevation view of the actuator plate of FIG. 6A along line I–I'.

The base member 28 may be a solid or a hollow member. The actuator plate 22 has a substantially straight edge 22*a* and a curved edge 22*b* as shown in FIG. 6A. The actuator plate 22 is pivotally connected at the straight edge to the base member 28 near the line edge where the bottom face 28*a* and the slanted face 28*b* meet. The curved edge 22*b* of the actuator plate 22 substantially conforms to the cross-sectional shape of the bag body 12 and to the membrane 32. The lower portion of the actuator shaft 20 extends longitudinally through a hole 42 in the base member 28, and the end 20*b* of the actuator shaft 20 is pivotally connected to the actuator plate 22 at a location near the curved edge 22*b* via, for example, a pair of bolts 22*c* or pins.

As shown in FIG. 4, a membrane 32 is provided to enclose the wedge-shaped cutout region 30. The membrane 32 is connected to the actuator plate 22 near the curved edge 22*b* thereof, and connected to the base member 28 at the lower end of a side face 28*c* thereof above the cutout region 30. The depending on the thickness and the material of the membrane 32, the bag 10 may require more or less force to tilt to compress the membrane 32. The membrane 32 may also be made of a transparent material to expose the pivoting mechanism of the actuator shaft 20 with the actuator plate 22. The membrane 32 is preferably attached to completely enclose the wedge-shaped cutout region 30. The attachment of the membrane 32 may be carried out by stitching, heat pressing, adhesives or other suitable process known to one of ordinary skill in the art.

The membrane 32 is preferably formed of a flexible and resilient material, such as rubber, silicon compound or the like. The membrane 32 may also be made of fabric or cloth materials. The membrane 32 may have air holes or bear designs. The entire lower portion of the golf bag shown in FIGS. 4 and 5 may preferably be covered by a fabric cover (not shown).

The actuator plate 22 pivots with respect to the base member 28 to actuate the operation of the support stand assembly. As shown in FIGS. 2 and 4, when the golf bag 10 is standing in the upright position, the actuator plate 22 is located substantially in the plane of the bottom face 28*a* of the base member 28, so that both the bottom face and the actuator plate are level with the ground. In this position, the actuator shaft 20 is not pushed up, so that the legs 16 assume their retracted position. In addition, when the actuator plate 22 is in the plane of the bottom face 28*a*, the resilient membrane 32 is in an expanded, undeformed or relatively less deformed state.

As shown in FIGS. 3 and 5, when the bag 10 which is standing upright on the ground is tilted as indicated by the arrow B, the actuator plate 22 is pressed against the ground (indicated by the line C) to pivot toward the slanted face 28*b* of the base member 28. This pushes the actuator shaft 20 longitudinally upwards as shown by the arrow D, which causes the legs 16 to pivot away from the bag body 12 to assume their extended position. As a result, the extended legs 16 and the actuator plate 22 form support points for the golf bag 10 so that the bag stands on the ground in a self-supported, leaning manner.

In addition, in the position shown in FIG. 5 where the actuator plate 22 is pivoted toward the slanted face 28*b* of the base member 28, the membrane 32 is in a compressed state. Compared with the expanded state as shown in FIG. 4, the compressed state is a deformed or more deformed state. The membrane 32 therefore tends to urge the actuator plate 22 to pivot back into the plane of the bottom face 28*a* as shown in FIG. 4, which corresponds to the retracted position of the legs 16. For this reason, this is also the position assumed when the bag is carried or laid sideways on the ground.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A golf bag comprising:

a body having a side surface and a bottom end, the body defining a longitudinal axis;

two legs pivotally connected to the body and being able to pivot between a retracted position where the legs are disposed substantially longitudinally along the side surface of the body and an extended position where lower ends of the legs are spaced apart from the body;

an actuator shaft disposed substantially longitudinally along the side surface of the body and longitudinally moveable relative to the body, a lower portion of the actuator shaft being disposed inside the body, the actuator shaft being connected to the legs so that the substantially longitudinal motion of the actuator shaft causes the pivoting motion of the legs; and an actuator mechanism coupled to the body near the bottom end thereof, the actuator mechanism being connected to the lower portion of the actuator shaft to effect the longitudinal motion of the actuator shaft, wherein the actuator mechanism comprises:

a base member disposed at the bottom end of the body, the base member having a bottom face substantially perpendicular to the longitudinal axis of the body and a slanted face disposed above the bottom face at an angle therewith to define a cutout region;

an actuator plate disposed within the cutout region defined by the base member and pivotally connected thereto, the actuator plate being able to pivot between a first position where it is disposed within the plane of the bottom face of the base member, and a second position where it is disposed near the slanted face; and a membrane attached to the base member and to the actuator plate to at least partially enclose the cutout region defined by the base member, wherein the lower end of actuator shaft is connected to the actuator plate so that the actuator shaft moves longitudinally when the actuator plate pivots between the first and the second position.

2. The golf bag of claim 1, wherein the membrane is made of a resilient material and tends to urge the actuator plate to pivot to its first position.

3. The golf bag of claim 1, wherein the membrane is made of a transparent material.

4. A golf bag comprising:

a body having a side surface and a bottom end, the body defining a longitudinal axis;

two legs pivotally attached to the body and being able to pivot between a retracted position where the legs are disposed substantially longitudinally along the side surface of the body and an extended position where lower ends of the legs are spaced apart from the body;

an actuator shaft disposed substantially longitudinally along the side surface of the body and longitudinally moveable relative to the body, the actuator shaft being connected at an upper portion to the legs so that the longitudinal motion of the actuator shaft effects the pivoting motion of the legs;

a base member disposed at the bottom end of the body, the base member having a bottom face and a slanted face extending from the bottom face at an angle therewith to define a cutout region;

an actuator plate disposed within the cutout region defined by the base member and pivotally connected to the base member, the actuator plate being able to pivot between a first position where it is disposed within the plane of the bottom face of the base member, and a second position where it is disposed near the slanted face, wherein a lower end of actuator shaft is connected to the actuator plate so that the actuator shaft moves longitudinally when the actuator plate pivots between the first and the second position; and a membrane attached to the base member and to the actuator plate to at least partially enclose the cutout region defined by the base member.

5. The golf bag of claim 4, wherein the membrane is made of a resilient material and tends to urge the actuator plate to pivot to its first position.

6. The golf bag of claim 4, wherein the lower end of the actuator shaft being disposed inside the body.

7. The golf bag of claim 6, wherein the body defines a through hole in a lower portion of the body and the lower end of the actuator shaft is connected to the actuating plate through the through hole.

8. The golf bag of claim 6, wherein the membrane is compressed when the actuator plate is in the second position.

9. The golf bag of claim 6, wherein the membrane is made of a resilient material and tends to urge the actuator plate to pivot to its first position.

10. A golf bag comprising:

a body having a side surface and a bottom end, the body defining a longitudinal axis;

two legs pivotally connected to the body and being able to pivot between a retracted position where the legs are disposed substantially longitudinally along the side surface of the body and an extended position where lower ends of the legs are spaced apart from the body;

an actuator disposed substantially longitudinally along the side surface of the body and longitudinally moveable relative to the body, a lower portion of the actuator being disposed inside the body, the actuator being connected at an upper portion to the legs so that the substantially longitudinal motion of the actuator causes the pivoting motion of the legs;

a base member disposed at the bottom end of the body, the base member having a bottom face substantially perpendicular to the longitudinal axis of the body and a slanted face extending from the bottom face at an angle therewith to define a cutout region; and a cover attached to the base member to at least partially cover the cutout region defined by the base member.

11. The golf bag of claim 10, further comprising:

an actuator plate disposed within the cutout region defined by the base member and pivotally connected thereto, the actuator plate being able to pivot between a first position where it is disposed within the plane of the bottom face of the base member, and a second position where it is disposed near the slanted face, wherein a lower end of the actuator is connected to the actuator plate so that the actuator moves longitudinally when the actuator plate pivots between the first and the second position.

12. The golf bag of claim 18, wherein the cover is made of a resilient material and tends to urge the actuator plate to pivot to its first position.

13. The golf bag of claim 18, wherein the cover is compressed when the actuator plate is in the second position.

14. The golf bag of claim 11, wherein the lower end of the actuator is disposed inside the body.

15. The golf bag of claim 14, wherein the body defines a through hole in a lower portion of the body and the lower end of the actuator shaft is connected to the actuating plate through the through hole.

16. The golf bag of claim 14, wherein the cover is made of a resilient material and tends to urge the actuator plate to pivot to its first position.

17. The golf bag of claim 10, wherein a lower end of the actuator is disposed inside the body.

18. The golf bag of claim 17, wherein the body defines a through hole in a lower portion of the body and the lower end of the actuator is connected to the actuator plate through the through hole.

19. The golf bag of claim 17, wherein the cover is made of a resilient material and tends to urge the actuator plate to pivot to its first position.

* * * * *